US008535006B2

(12) United States Patent
Lee

(10) Patent No.: US 8,535,006 B2
(45) Date of Patent: Sep. 17, 2013

(54) NEAR-WALL SERPENTINE COOLED TURBINE AIRFOIL

(75) Inventor: Ching-Pang Lee, Cincinnati, OH (US)

(73) Assignee: Siemens Energy, Inc., Orlando, FL (US)

( * ) Notice: Subject to any disclaimer, the term of this patent is extended or adjusted under 35 U.S.C. 154(b) by 683 days.

(21) Appl. No.: 12/836,060

(22) Filed: Jul. 14, 2010

(65) Prior Publication Data

US 2012/0014808 A1 Jan. 19, 2012

(51) Int. Cl.
*F01D 5/18* (2006.01)

(52) U.S. Cl.
USPC ..... 416/97 R

(58) Field of Classification Search
USPC ..... 415/115; 416/95, 96 R, 97 R, 97 A, 416/96 A
See application file for complete search history.

(56) References Cited

U.S. PATENT DOCUMENTS

| | | | | |
|---|---|---|---|---|
| 2,956,773 | A * | 10/1960 | French | 416/90 R |
| 3,864,058 | A * | 2/1975 | Womack | 416/97 R |
| 5,486,090 | A | 1/1996 | Thompson et al. | |
| 5,967,752 | A * | 10/1999 | Lee et al. | 416/97 R |
| 5,971,708 | A | 10/1999 | Lee | |
| 6,099,252 | A | 8/2000 | Manning et al. | |
| 6,273,682 | B1 | 8/2001 | Lee | |
| 6,612,808 | B2 * | 9/2003 | Lee et al. | 415/175 |
| 6,984,103 | B2 | 1/2006 | Lee et al. | |
| 7,131,818 | B2 | 11/2006 | Cunha et al. | |
| 7,296,972 | B2 | 11/2007 | Liang | |
| 7,296,973 | B2 | 11/2007 | Lee et al. | |
| 7,347,671 | B2 | 3/2008 | Dorling et al. | |
| 7,527,474 | B1 | 5/2009 | Liang | |
| 7,534,089 | B2 | 5/2009 | Liang | |
| 7,549,843 | B2 | 6/2009 | Liang | |
| 7,686,581 | B2 | 3/2010 | Brittingham et al. | |
| 7,695,245 | B1 | 4/2010 | Liang | |
| 7,699,583 | B2 | 4/2010 | Cunha | |
| 7,704,046 | B1 | 4/2010 | Liang | |
| 7,713,027 | B2 | 5/2010 | Cherolis et al. | |
| 7,717,675 | B1 | 5/2010 | Liang | |
| 8,096,766 | B1 * | 1/2012 | Downs | 416/96 R |
| 8,262,355 | B2 * | 9/2012 | Kopmels | 416/96 R |
| 2007/0104576 | A1 | 5/2007 | Cunha et al. | |
| 2008/0118366 | A1 | 5/2008 | Correia et al. | |
| 2009/0285683 | A1 | 11/2009 | Pietraszkiewicz et al. | |

FOREIGN PATENT DOCUMENTS

JP 61279702 A * 12/1986

* cited by examiner

*Primary Examiner* — Nathaniel Wiehe
*Assistant Examiner* — Ryan Ellis

(57) ABSTRACT

A serpentine coolant flow path (54A-54G) formed by inner walls (50, 52) in a cavity (49) between pressure and suction side walls (22, 24) of a turbine airfoil (20A). A coolant flow (58) enters (56) an end of the airfoil, flows into a span-wise channel (54A), then flows forward (54B) over the inner surface of the pressure side wall, then turns behind the leading edge (26), and flows back along a forward part of the suction side wall, then follows a loop (54E) forward and back around an inner wall (52), then flows along an intermediate part of the suction side wall, then flows into an aft channel (54G) between the pressure and suction side walls, then exits the trailing edge (28). This provides cooling matched to the heating topography of the airfoil, minimizes differential thermal expansion, revives the coolant, and minimizes the flow volume needed.

20 Claims, 4 Drawing Sheets

NEAR-WALL SERPENTINE COOLED TURBINE AIRFOIL

STATEMENT REGARDING FEDERALLY SPONSORED DEVELOPMENT

Development for this invention was supported in part by Contract Number DE-FC26-05NT42644, awarded by the United States Department of Energy. Accordingly, the United States Government may have certain rights in this invention.

FIELD OF THE INVENTION

This invention relates to coolant flow channels in turbine airfoils, and particularly in curved vanes.

BACKGROUND OF THE INVENTION

Stationary guide vanes and rotating turbine blades in gas turbines often have internal cooling channels. Cooling effectiveness is important in order to minimize thermal stress on these airfoils. Cooling efficiency is important in order to minimize the volume of air diverted from the compressor for cooling.

Film cooling provides a film of cooling air on outer surfaces of an airfoil via holes in the airfoil surface from internal cooling channels. Film cooling can be inefficient, because so many holes are needed that a high volume of cooling air is required. Thus, film cooling has been used selectively in combination with other techniques.

Impingement cooling is a technique in which perforated cooling tubes are inserted into span-wise channels in an airfoil to create impingement jets against the inner surfaces of the airfoil. A disadvantage is that warmer post-impingement air moves along the inner surfaces of the airfoil and interferes with the impingement jets. Impingement tubes require a nearly straight airfoil for insertion, but some turbine airfoils have a curved span for aerodynamic efficiency.

Another technique uses serpentine cooling channels that go from one end of the airfoil to the other and back. Air in such channels is much cooler at the beginning of the flow sequence, so it can cool the airfoil unevenly.

The present invention provides high efficiency, a cooling rate topography that matches the heating topography of an airfoil, coolant revival at mid-flow, and reduction of differential thermal expansion. It does not require impingement tube inserts, and can be formed in curved airfoils. Thus, it overcomes all of the above-mentioned disadvantages.

BRIEF DESCRIPTION OF THE DRAWINGS

The invention is explained in the following description in view of the drawings that show.

DETAILED DESCRIPTION OF THE INVENTION

Figure 1:
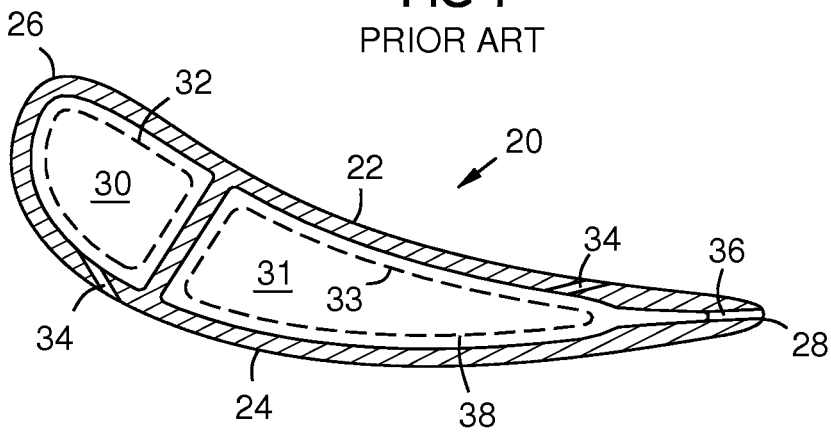
FIG 1 PRIOR ART
FIG. 1 is a transverse sectional view of a prior art turbine vane with impingement cooling inserts.

FIG. 1 is a transverse sectional view of a prior art turbine vane 20 with a pressure side wall 22, a suction side wall 24, a leading edge 26, a trailing edge 28, internal cooling channels 30, 31, impingement cooling baffles 32, 33, film cooling holes 34, and coolant exit holes 36. The impingement cooling baffles are thin-walled tubes inserted into the cooling channels 30, 31. They are spaced apart from the channel walls. Cooling air enters an end of each impingement baffle 32, 33, and flows span-wise within the vane. It exits impingement holes 38, and impinges on the walls 22, 24.

Figure 2:
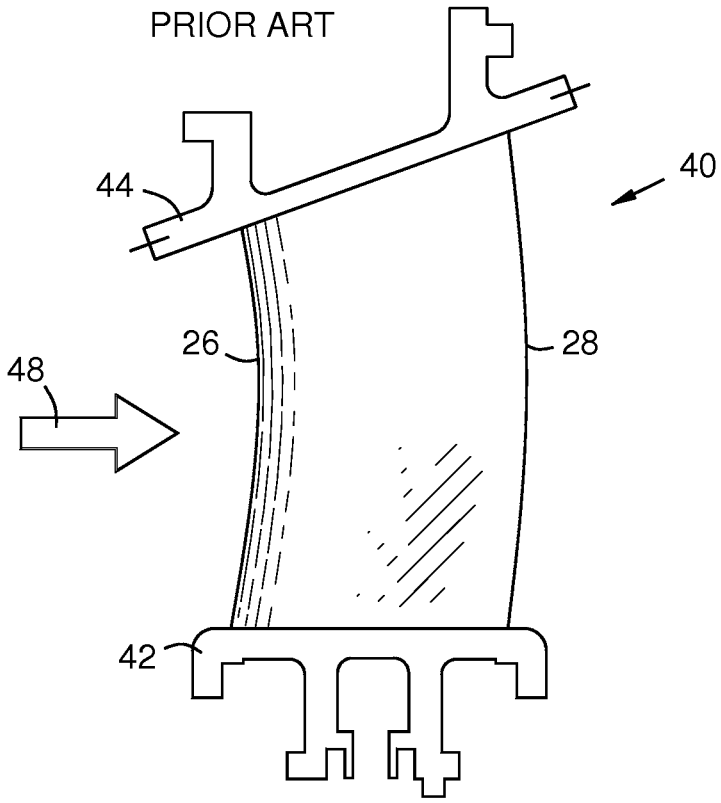
FIG 2 PRIOR ART
FIG. 2 is a side view of a prior art curved gas turbine vane.

FIG. 2 shows a side view of a prior art curved turbine vane 40 that spans between radially inner and outer platforms 42, 44. The platforms are mounted in a circular array of adjacent platforms, forming inner and outer shrouds that define an annular flow path between them for a working gas 48 that passes over the vanes.

Figure 3:
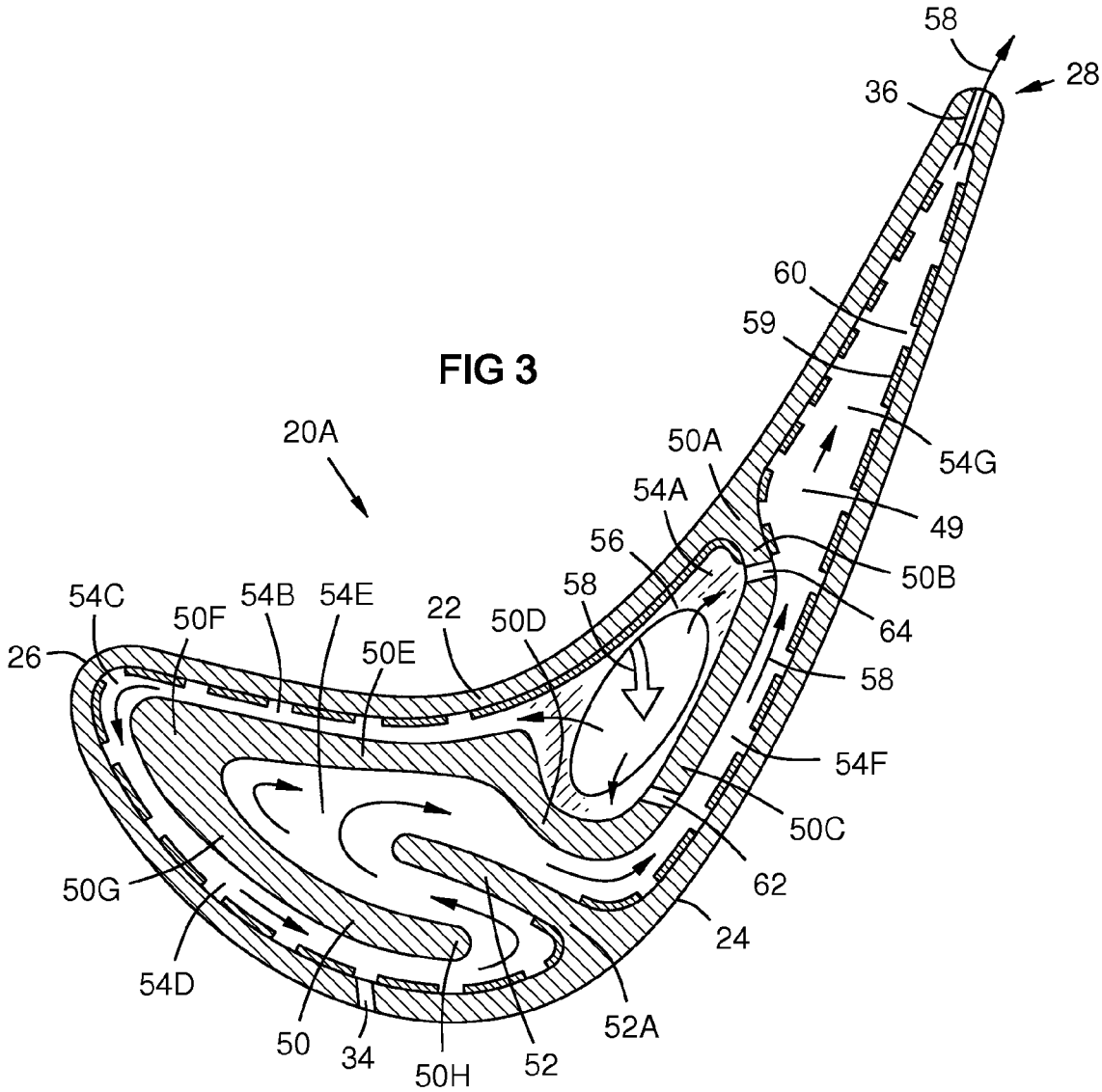
FIG. 3 is a transverse sectional view of a turbine airfoil showing aspects of the invention.

FIG. 3 shows a transverse section of an airfoil with a pressure side wall 22 and a suction side wall 24 connected to each other at a leading edge 26 and a trailing edge 28. Within the airfoil is a cavity 49 with a first inner wall 50 and a second inner wall 52, defining a continuous serpentine cooling flow path with a sequence of segments as follows:

a) a cooling inlet channel 54A that extends span-wise along at least a portion of the pressure side wall 22;

b) a forward pressure side near-wall channel 54B along a forward portion of the pressure side wall;

c) a leading edge near-wall channel 54C;

d) a forward suction side near-wall channel 54D along a forward portion of the suction side wall;

e) a loop channel 54E routed forward toward the leading edge 26 then back, between the first and second inner walls 50, 52;

f) an intermediate suction side near-wall channel 54F along an intermediate portion of the suction side wall 24; and g) an aft channel 54G between the pressure and suction side walls 22, 24 aft of the cooling inlet channel 54A. Some or all of the coolant flow 58 may exit the airfoil via holes 36 in the trailing edge 28.

Herein, the term "radial" means in a direction of the airfoil span from root to tip and perpendicular in relation to the turbine rotational axis when the airfoil is installed in a turbine. "Transverse section" means a section through the airfoil taken on a plane normal to the airfoil span. "Chord line" is a line connecting the leading and trailing edge in a given transverse section of the airfoil. "Span-wise" means oriented substantially in a direction of a line or curve connecting the midpoints of all chord lines of an airfoil. "Span-wise" may be the same or approximately the same as "radial" for a straight airfoil. However, it curves in airfoils that curve along their span as in FIG. 2. "Forward" and "aft" mean toward the leading or trailing edge respectively within a transverse section of the airfoil.

The span-wise cooling inlet channel 54A, as seen in the transverse section, may be located adjacent to the pressure side wall at position between 30% and 70% of a chord length from the leading edge of the airfoil. The first inner wall 50 may have a first end 50A that is joined to an inner surface of the pressure side wall 22 at a position between 50% and 75% of a chord length from the leading edge.

Coolant refreshment holes 62, 64 may be provided in the first inner wall 50 between the cooling inlet channel 54A and the intermediate suction side channel 54F and/or between the cooling inlet channel 54A and the aft channel 54G. Film cooling holes 34 may be provided, for example in the suction side wall upstream of the coolant refreshment holes.

The cooling flow path 54A-G may be narrowed along hotter portions of the airfoil outer walls 22, 24, 26, 28, to locally increase the cooling flow speed via the Bernoulli principle, and thus locally increase cooling. This provides the designer with a mechanism to fine tune the cooling topography on the airfoil outer walls in the design phase to match the heating topography of the airfoil.

Figure 4:
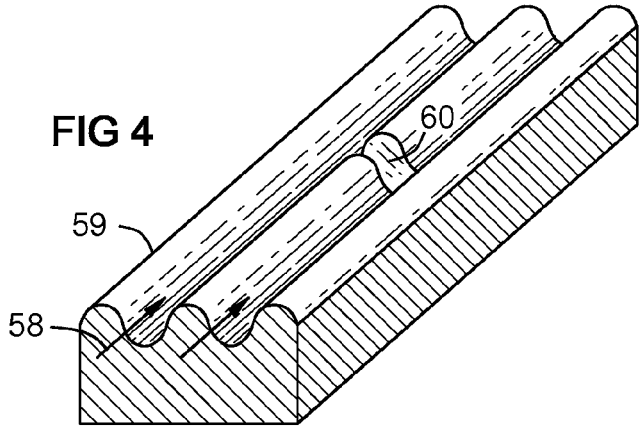
FIG. 4 is a perspective view of a portion of an airfoil wall with corrugations.

FIG. 4 shows corrugations 59, which may be provided on the inner surfaces of the pressure and suction side walls 22, 24 to increase their surface area for the coolant flow 58. The corrugations may be aligned with the flow 58, to minimize resistance. Periodic gaps 60 or other discontinuities in the corrugations may be provided to restart the boundary layer to mix cooler air into a newly formed boundary layer.

Figure 5:
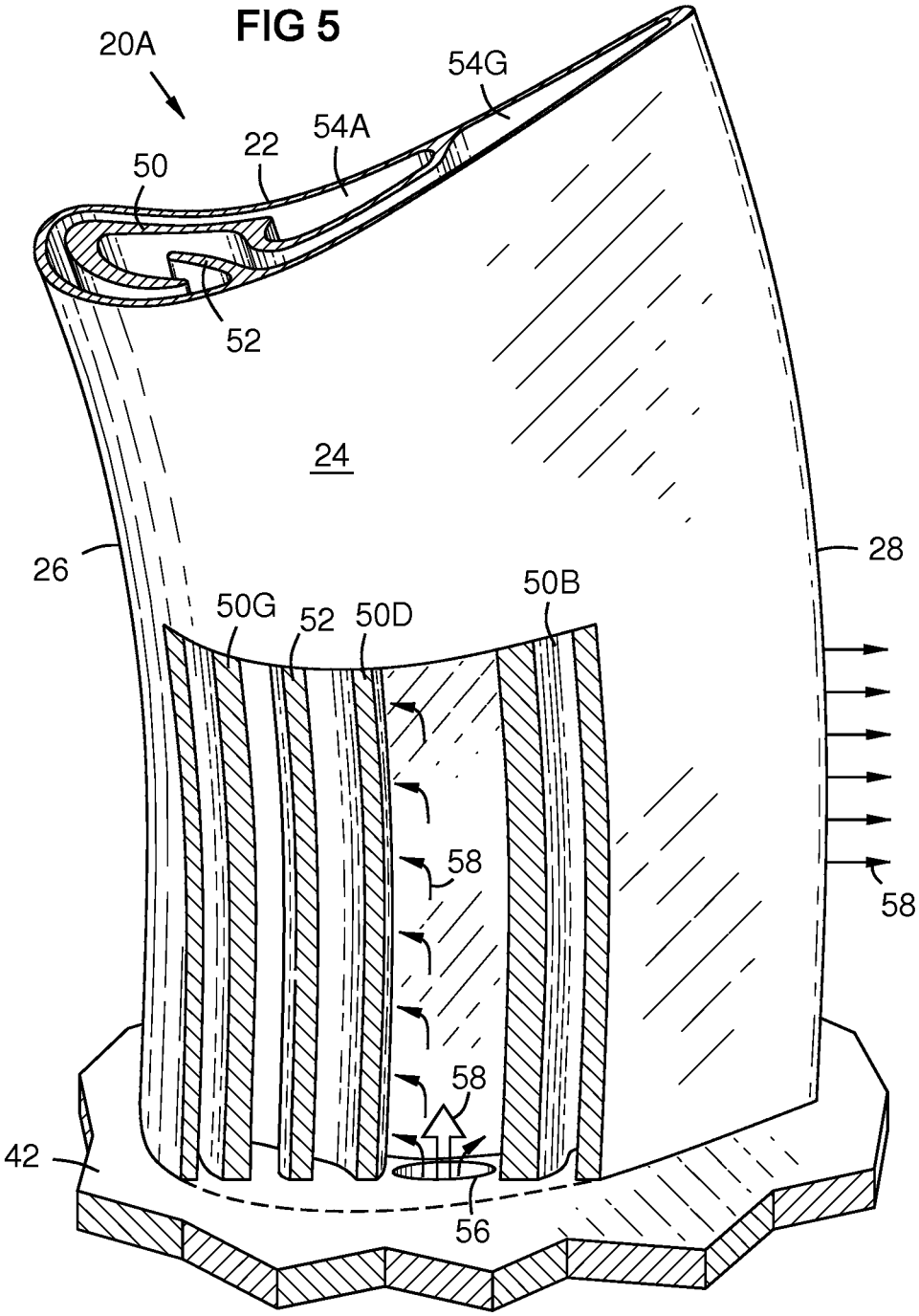
FIG. 5 is a perspective cutaway sectional view of a curved vane and part of an inner platform showing aspects of the invention.

FIG. 5 is a perspective sectional view of a curved vane 20A and part of an inner platform 42. A cutaway provides an inner view of parts of the inner walls 50 and 52. The radially inner and outer ends of the airfoil outer walls 22, 24, 26, 28 and inner walls 50, 52, may be integral with the respective platform 42, 44, or attached thereto. The inner walls 50, 52 extend span-wise along at least a portion of the span of the airfoil, as if they were extruded span-wise from the transverse section of FIG. 3. However, casting may be used for fabrication. One or both ends of the cooling inlet channel 54A may be supplied with coolant through an inlet 56.

Figure 6:
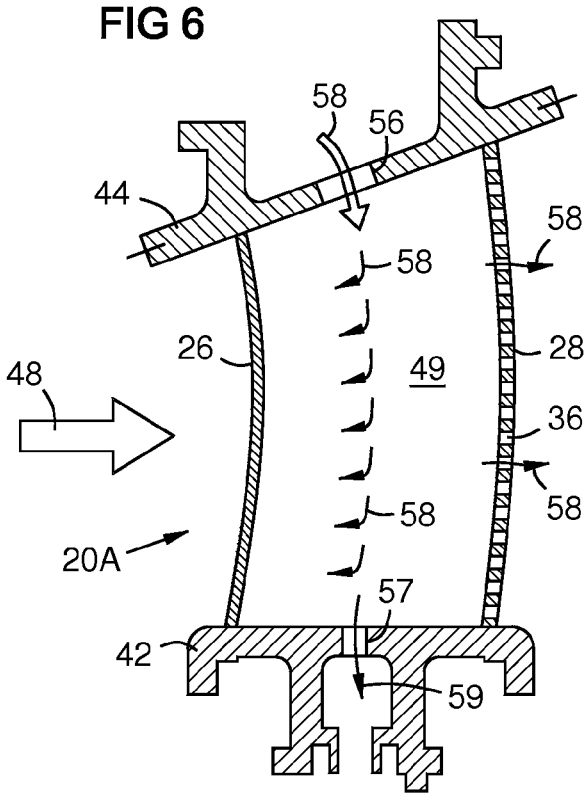
FIG. 6 is a sectional side view of a curved turbine vane between inner and outer platforms, showing aspects of the invention.

FIG. 6 is a sectional side view of a curved turbine vane 20A with a cavity 49 between inner and outer platforms 42, 44. For clarity, the inner walls 50 and 52 are not shown. Cooling air 58 from the turbine compressor may enter the cavity 49 through one or more inlets 56 in the outer platform 44. The coolant follows a serpentine path as previously shown, and may exit the vane via trailing edge exit holes 36. Part of the coolant 58 may exit a metering hole 57 in the inner platform 42, to supply a plenum and channels that cool the inner shroud. Alternately, the coolant 58 may enter the inner 42 platform as shown in FIG. 5. In this case, part of the coolant may exit a metering hole in the outer platform. Alternately, the coolant 58 may enter both the inner and outer platforms 42, 44.

Figure 7:
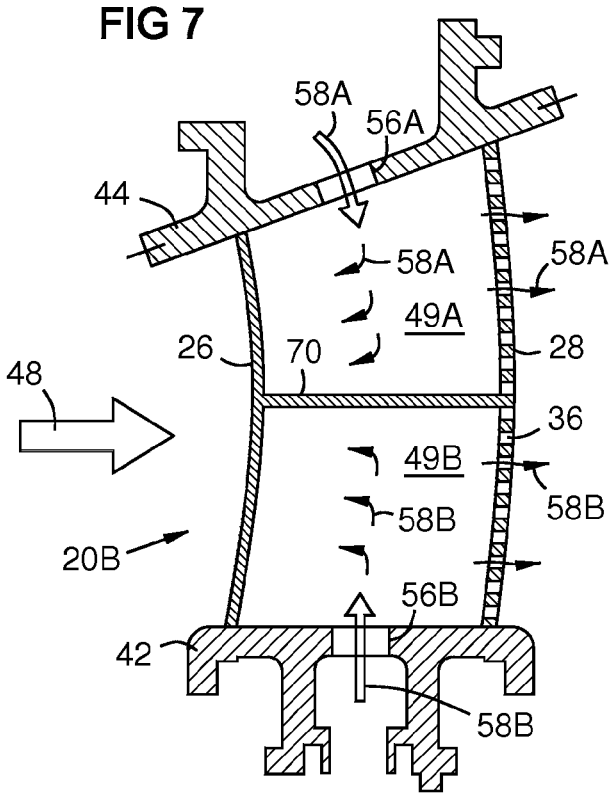
FIG. 7 is a sectional side view of a curved turbine vane between inner and outer platforms with a transverse partition providing radially inner and outer cooling circuits.

FIG. 7 shows a sectional side view of a curved turbine vane 20B with two cavities 49A and 49B separated by a transverse partition 70. Two coolant flows 58A, 58B from the turbine compressor may enter the respective cavities 49A, 49B through one or more respective inlets 56A 56B. The two coolant flows 58A, 58B may be differently metered by the respective inlet opening sizes or by other means in order to customize the flow volumes in the cavities 49A, 49B to different requirements for the radially outer and inner portions of the vane.

Fabrication of the airfoils 20A, 20B including the inner walls 50, 52 may be done by any known process including an advanced casting technique described in U.S. Pat. No. 7,141,812 of Mikro Systems Incorporated. The airfoil may be cast separately from the platforms, and joined thereto, or the airfoil and platforms may be cast integrally as one part. If they are cast integrally, the inner walls 50, 52 only need to be attached to the pressure and suction side walls 22, 24 at one end of each inner wall 50A, 52A as shown in FIG. 3. The radial ends of the inner walls 50, 52 may be integral with, or attached to, the platforms 42, 44. Additional attachment points (not shown) between the inner walls 50, 52 and the outer walls 22, 24, 26, 28 may be provided if needed for structural strength or vibration damping. The corrugations 59 may be cast integrally with the pressure and suction side walls 22, 24.

Benefits of the invention can be seen by following the coolant flow in FIG. 3. First, the coolant enters the cooling inlet channel 54A, then it spreads over a front portion of the pressure side wall 22. This is where the airfoil is hottest, and where the coolant flow 58 is coolest. Next, the coolant turns around behind the leading edge 26 and flows back along a front portion of the suction side wall 24. Now the coolant has gained heat, and has lost some of its cooling capacity. However, as it flows around the loop circuit 54E, it is cooled by the inner wall segments 50E, 50D. This revives the cooling capacity of the flow 58. It also warms the inner wall segments 50E, 50D, which reduces the temperature disparity between these otherwise cool inner wall segments and the hot pressure side wall 22, reducing stress from differential thermal expansion. Furthermore, the speed of the flow across the surface to be cooled may be increased because the cross-sectional area of the flow path is reduced in this region compared to channel 54A. The revived coolant then follows intermediate and aft channels 54F, 54G. The coolant may be further revived by refreshment holes 62, 64, as previously described. However, these holes may not be needed. Corrugations 59 may be provided as previously described, and may be aligned with the flow 58, thus providing increased surface area with minimal friction. The coolant flow boundary layer may be restarted periodically via the gaps 60. These features make optimum use of the coolant, and minimize the flow volume needed.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A turbine airfoil comprising:

a pressure side wall and a suction side wall connected to each other along leading and trailing edges;

a cavity disposed between the pressure and suction side walls;

a continuous serpentine cooling flow path formed by first and second inner walls in the cavity, wherein the continuous serpentine cooling flow path routes a coolant flow in the following sequence as seen in a transverse section of the airfoil:

a) a cooling inlet channel that extends span-wise along at least a portion of the pressure side wall;

b) a forward pressure side near-wall channel along a forward portion of the pressure side wall;

c) a leading edge near-wall channel;

d) a forward suction side near-wall channel along a forward portion of the suction side wall;

e) a loop channel routed forward then back, between the first and second inner walls;

f) an intermediate suction side near-wall channel along an intermediate portion of the suction side wall; and g) an aft channel that is aft of the cooling inlet channel between the pressure and suction side walls.

2. The turbine airfoil of claim 1, wherein the span-wise cooling inlet channel, as seen in the transverse section, is adjacent to the pressure side wall at position between 30% and 70% of a chord length from the leading edge of the airfoil.

3. The turbine airfoil of claim 1, wherein the first inner wall comprises a first end joined to an inner surface of the pressure side wall at a position between 50% and 75% of a chord length from the leading edge, and the first inner wall extends span-wise along at least a portion of the airfoil.

4. The turbine airfoil of claim 1, wherein the continuous serpentine cooling flow path extends span-wise along a full span of the airfoil.

5. The turbine airfoil of claim 1, wherein the cavity is partitioned by a transverse partition into two continuous serpentine cooling flow path routes each according to claim 1 with respective coolant inlets.

6. The turbine airfoil of claim 1, further comprising corrugations on an inner surface of at least one of the pressure and suction side walls, wherein the corrugations are aligned with a coolant flow direction, and the corrugations comprise periodic gaps that restart a boundary layer in a coolant flow along the inner surfaces of the pressure and suction side walls.

7. The turbine airfoil of claim 1, further comprising a coolant refreshment hole in the first inner wall between the cooling inlet channel and the intermediate suction side near-wall channel or between the cooling inlet channel and the aft channel, and further comprising a film cooling hole in the suction side wall upstream of the coolant refreshment hole.

8. The turbine airfoil of claim 1, wherein the cooling flow path narrows at a portion of the airfoil to locally increase a coolant flow speed.

9. The turbine airfoil of claim 8, further comprising corrugations formed on an inner surface of at least one of the pressure side wall and the suction side wall.

10. A turbine airfoil comprising:

a pressure side wall and a suction side wall connected to each other along leading and trailing edges;

a cavity disposed between the pressure and suction side walls;

first and second inner walls within the cavity forming a continuous serpentine cooling flow path as seen in a transverse section of the airfoil;

wherein the first inner wall comprises a first end that joins an inner surface of the pressure side wall, thence extends toward the suction side wall, thence extends forward beside the suction side wall, thence extends toward the pressure side wall, thence extends forward beside the pressure side wall, thence turns behind the leading edge, thence extends aft beside the suction side wall, thence terminates in a second end; and wherein the second inner wall comprises a first end that joins an inner surface of the suction side wall aft of the second end of the first inner wall and extending away from the suction side wall, thus defining a generally U-shaped loop forward and back in the cooling flow path around the second inner wall and between the first and second inner walls.

11. The turbine airfoil of claim 10, further comprising a coolant inlet opening into a span-wise cooling air inlet channel between the first inner wall and the pressure side wall, adjacent to and forward of the first end of the first inner wall, and wherein the continuous serpentine cooling flow path then passes forward along the inner surface of the pressure side wall, thence around an inner surface of the leading edge, thence aft along the inner surface of the suction side wall, thence forward and back around the generally U-shaped loop, thence along the suction side wall, thence into a channel between the pressure side and suction side walls aft of the first end of the first inner wall.

12. The turbine airfoil of claim 11, wherein the first end of the first inner wall joins the inner surface of the pressure side wall at a position that is between 50% and 75% of a chord length from the leading edge.

13. The turbine airfoil of claim 11, wherein the continuous serpentine cooling flow path extends along a full span of the airfoil.

14. The turbine airfoil of claim 11, wherein the cavity is partitioned by a transverse partition into two continuous serpentine cooling flow paths each according to claim 11 with respective coolant inlets.

15. The turbine airfoil of claim 11, further comprising corrugations on inner surfaces of the pressure and suction side walls, wherein the corrugations are aligned with a coolant flow direction substantially transversely to a span of the airfoil, and the corrugations comprise periodic gaps that restart a boundary layer in a coolant flow along the inner surfaces of the pressure and suction side walls.

16. The turbine airfoil of claim 11, further comprising a coolant refreshment hole in the first inner wall between the cooling inlet channel and a subsequent portion of the serpentine cooling flow path.

17. The turbine airfoil of claim 11, wherein the cooling flow path narrows at a portion of the airfoil to locally increase a coolant flow speed.

18. The turbine airfoil of claim 11, wherein the first and second inner walls are connected to, or are integral with, radially inner and outer platforms at each respective end of the airfoil.

19. A turbine airfoil comprising a continuous serpentine cooling flow path in a cavity between pressure and suction side walls of a turbine airfoil, the serpentine cooling flow path comprising a flow sequence comprising an inlet at an end of the airfoil, a span-wise channel, a forward pressure side wall channel that turns behind a leading edge of the airfoil, a forward suction side wall channel along a forward part of the suction side wall, a loop channel that loops forward and back between the forward pressure side wall channel and the forward suction side wall channel, an intermediate suction side wall channel along an intermediate part of the suction side wall, an aft channel between the pressure and suction side walls, and a coolant exit hole in a trailing edge of the airfoil.

20. The turbine airfoil of claim 19, further comprising a refreshment flow path from the span-wise channel to the intermediate suction side wall channel or to the aft channel.

* * * * *

UNITED STATES PATENT AND TRADEMARK OFFICE

CERTIFICATE OF CORRECTION

PATENT NO. : 8,535,006 B2
APPLICATION NO. : 12/836060
DATED : September 17, 2013
INVENTOR(S) : Ching-Pang Lee It is certified that error appears in the above-identified patent and that said Letters Patent is hereby corrected as shown below:

On the Title Page insert item (73) Assignee --Mikro Systems, Inc.--

Signed and Sealed this
Twentieth Day of October, 2015

Michelle K. Lee

Michelle K. Lee
*Director of the United States Patent and Trademark Office*